US006104825A

United States Patent [19]

Thigpen

[11] Patent Number: 6,104,825

[45] Date of Patent: Aug. 15, 2000

[54] PLANAR MAGNETIC TRANSDUCER WITH DISTORTION COMPENSATING DIAPHRAGM

[75] Inventor: F. Bruce Thigpen, Tallahassee, Fla.

[73] Assignee: Eminent Technology Incorporated, Tallahassee, Fla.

[21] Appl. No.: 08/917,935

[22] Filed: Aug. 27, 1997

[51] Int. Cl.[7] ..... H04R 25/00

[52] U.S. Cl. ..... 381/408; 381/431

[58] Field of Search ..... 381/399, 408, 381/423, 424, 431, FOR 156, FOR 163; 181/157, 163, 164, 165, 167, 170

[56] References Cited

U.S. PATENT DOCUMENTS

| | | | |
|---|---|---|---|
| 3,073,411 | 1/1963 | Bleazey et al. . | |
| 3,164,686 | 1/1965 | Tibbetts . | |
| 3,829,623 | 8/1974 | Willis et al. | 381/408 |
| 3,898,598 | 8/1975 | Asahi | 381/408 |
| 4,317,966 | 3/1982 | Lister . | |
| 4,319,096 | 3/1982 | Winey . | |
| 4,434,203 | 2/1984 | Briefer . | |
| 4,461,932 | 7/1984 | Oyaba . | |
| 4,550,228 | 10/1985 | Walker et al. . | |
| 4,580,014 | 4/1986 | Hobrough . | |
| 4,837,838 | 6/1989 | Thigpen et al. . | |

FOREIGN PATENT DOCUMENTS

| | | | |
|---|---|---|---|
| 0116957 | 8/1984 | European Pat. Off. . | |
| 2461258 | 7/1976 | Germany . | |
| 2461258 | 7/1996 | Germany | 381/FOR 156 |
| 0165596 | 9/1984 | Japan . | |
| 0160799 | 8/1985 | Japan . | |
| 084000460 | 2/1984 | WIPO | 381/FOR 156 |

*Primary Examiner*—Huyen Le
*Attorney, Agent, or Firm*—Dowell & Dowell, P.C.

[57] ABSTRACT

Diaphragms of planar magnetic transducers having electrical conductor runs applied thereto are deformed to create lines of flexation such as by knurling, pressing, embossing or the like prior to being placed under tension within a support frame so as to reduce loss of diaphragm tension and thereby control resonance modes along active surface areas of the diaphragm when electrical energy is applied through the conductor runs.

20 Claims, 3 Drawing Sheets

40
45
46
4
38

20
21
30
22
28
25
40

46
38'
38

34
35

PLANAR MAGNETIC TRANSDUCER WITH DISTORTION COMPENSATING DIAPHRAGM

BACKGROUND OF THE INVENTION

1. Field of the Invention

The present invention is directed to the field of planar magnetic transducers and, more particularly, to the treatment of diaphragms and conductor circuits associated with diaphragms which are mounted in spaced proximity to permanent magnets mounted to support frames forming the transducers. More specifically, the invention is directed to physically deforming the diaphragms and/or conductor circuits applied thereto when in a non-tensioned state and thereafter stretching the diaphragms and conductor circuits to place them under tension within a support frame. When mounted, the diaphragms are relatively flat but contain creases or ridge lines which allow limited flexing of the diaphragms and/or conductor circuits for purposes of maintaining diaphragm tension and reducing distortion of the diaphragms during use and to compensate for temperature variances created by the passage of electricity through the conductors during use of the transducers.

2. History of the Related Art

Planar magnetic transducers or speakers conventionally utilize flat metallic foils or wires to create conductor runs on the surface of a diaphragm which is mounted within a support frame and held under tension generally in a plane parallel to the pole faces of one or more permanent magnets. The path for the electrical conductor runs on a diagram is generally chosen so the current flowing through the conductor induces net magnetic forces of uniform direction for all of the conductor segments or runs within what is referenced as an "active area" or "active surface area" of the diaphragm, thereby causing the general direction of diaphragm motion to be perpendicular to the diaphragm surface during operation of the transducer. The "active area" or "active surface area" of the diaphragm, and as described and referenced throughout this application, both in the specification and claims, is that area of the diaphragm which is not constrained from motion by a rigid frame which supports the diaphragm relative to the one or more permanent magnets.

The conductor runs applied to a diaphragm result in resonance modes which cause the diaphragm to exhibit modal behavior patterns at certain frequencies throughout the operating range of the transducer when power is applied to the electrical conductor circuits from a conventional amplifier. During the use of smaller planar magnetic transducers, as power levels increase beyond approximately one watt per square inch, heat builds up along the metal conductor runs or segments. The conductors are typically an aluminum material which expands at a much greater rate than the substrate of the diaphragm which may be a synthetic plastic or film, such as Mylar™. The heat causes the two materials to expand at different rates resulting in a loss of tension or non-uniform tension over parts of the "active area" or "active surface area" of the diaphragm. In large planar magnetic loudspeakers with diaphragms in excess of 100 square inches, the surface area of the diaphragm limits the temperature buildup and diaphragms exhibit relatively normal behavior when electrical energy is applied to the conductor circuits. However, with small planar magnetic transducers used as loudspeakers, the heat buildup is greater for a given amount of input power because of the reduced surface area of the diaphragm associated therewith.

The loss of tension across a diaphragm results in non-uniform displacement of the diaphragm during operation.

Such non-uniform displacement of the diaphragm in turn causes several forms of distortion limiting maximum usable sound output. The non-uniform displacement also causes a non-piston-like behavior of the diaphragm creating valleys and peaks in the frequency response of the loudspeaker, thus resulting in non-linear sound output levels at varying frequencies. The non-uniform displacement also creates a doubling or buzzing type of distortion where multiple harmonics may be generated at the diaphragm. In such instances, the diaphragm moves at two different directions at the same time. This movement behavior takes the form of pockets of the diaphragm moving in opposite directions which results in a change of output when different frequencies are applied to the loudspeaker. As the input frequency is changed, various patterns emerge from the diaphragm due to the velocity of the waves traveling along the diaphragm. Ideally, the behavior of the diaphragm is like a piston throughout the normal frequency operating range.

It should be noted that ribbon loudspeakers, ribbon tweeters and planar ribbon loudspeakers utilize diaphragms which are not tensioned and are usually loosely suspended. Such loudspeakers have made use of corrugated aluminum diaphragms but not for purposes of reducing loss of tension across a diaphragm or for compensating or offsetting for heat buildup of conductors extending across a diaphragm.

SUMMARY OF THE INVENTION

The present invention is directed to a planar magnetic transducer incorporating a diaphragm having electrical conductor runs mounted thereon, or etched thereto, wherein the diaphragms and/or conductor runs are initially physically deformed before being stretched or made taut and applied to a support frame associated with the transducer. The transducer includes the frame to which the diaphragm having the electrical conductor runs applied thereto is supported under tension in such a manner so as to define an active surface area spaced inwardly of the frame. A plurality of permanent magnets are mounted so as to be in proximity but spaced from the diaphragm and, in the preferred embodiment, are mounted on opposite sides of the diaphragm so as to create a push-pull effect on the diaphragm during use. In some embodiments, the frame may be supported by an outer frame to which the magnets are supported or a common or single frame may be utilized to support both the magnets as well as the diaphragm. At least a portion of the active surface area of the diaphragm and/or the electrical conductor runs carried thereby are deformed so as to create a plurality of ridges or grooves in the surface thereof such that, even though the diaphragm and conductors are mounted taut within a support frame, the areas which have been physically deformed remain and thereby create areas of expansion which allow the diaphragm and the electrical conductor runs to expand and contract during the operation of the transducer.

In the preferred embodiment, the diaphragm is creased such as by a knurling or embossing process wherein a plurality of generally parallel lines of depression are created across the active surface area of the diaphragm including the conductor runs mounted thereto with the lines being made transversely and, more preferably, generally perpendicularly with respect to the length of the electrical conductor runs extending along the surface of the diaphragm. In other embodiments, the lines of depression may be patterned or embossed in varying configurations and may extend at different angles relative to the conductor runs across the surface of the diaphragms and, in some instances, may be formed in concentric patterns such as a series of enlarging circles or enlarging rectangles. Other patterns such as a spiral pattern or random patterns may be created depending upon the size and nature of the diaphragm and the end use of the transducer. In addition, the density of the lines of depression may vary across the diaphragm.

In the preferred embodiment of the present invention, the permanent magnets associated with the transducers are mounted so that like pole faces are disposed in general alignment with one another on opposite sides of an active surface area of the diaphragm.

In the methodology of the present invention, the transducer is produced by initially applying the conductor runs to a surface of the diaphragm wherein the conductor runs preferably extend in parallel relationship with respect to one another along the active surface area of the diaphragm so that the path of the conductor runs is chosen such that the current flowing through the conductor runs induces net magnetic forces of uniform direction for all the conductor segments across the active surface area of the diaphragm relative to the adjacent permanent magnets associated with the transducer. In the preferred embodiment, the electrical circuits are etched from a foil laminate secured to the surface of the diaphragm. The diaphragm and applied conductors are thereafter mechanically deformed such as by vacuum forming, knurling, rolling, stamping or embossing to create lines of depression across the active surface of the diaphragm and conductor runs while the conductor runs and diaphragm are in a relaxed state. Thereafter, the diaphragm is pulled tight in an appropriate fixture so as to provide tension, multi-directionally, with respect to an elongated axis of the diaphragm. The diaphragm is thereafter placed in a frame and adhered thereto so as to be retained under tension. When placed within the support frame, the diaphragm is relatively flat, however, the mechanically deformed pattern remains and provides elasticity to the diaphragm and conductor runs during the use of the transducer.

It is the primary object of the present invention to provide a means for increasing the maximum sustainable output of small planar magnetic transducers in order to enable small planar magnetic transducers to be suitable for uses not previously possible in the technology.

It is also an object of the present invention to provide a method for forming planar magnetic transducers and to planar magnetic transducers incorporating diaphragms having electrical conductors applied thereto wherein the diaphragm and/or electrical conductors are mechanically deformed in order to reduce distortion and increase the maximum sound pressure level of the diaphragms when placed under tension in supporting frames relative to permanent magnets associated with the transducers.

It is a further object of the present invention to provide a diaphragm for use with a planar magnetic transducer wherein the diaphragm has an electrical conductor applied thereto which is selectively mechanically deformed so as to allow for expansion and contraction of the diaphragm and the electrical conductor when power is applied to the electrical conductor and wherein the mechanical deformation results in a reduction of distortion of the diaphragm so as to create a more uniform displacement of the diaphragm during the operation of the magnetic transducer.

It is also an object of the present invention to provide a diaphragm incorporating an electrical conductor circuit thereon for planar magnetic transducers which reduces the need for precise tensioning of the diaphragm relative to a support frame associated with a transducer speaker assembly wherein the diaphragm and/or the conductor runs are mechanically deformed to allow for expansion and contraction during operation of a transducer.

DESCRIPTION OF THE PREFERRED EMBODIMENT

Figure 1:
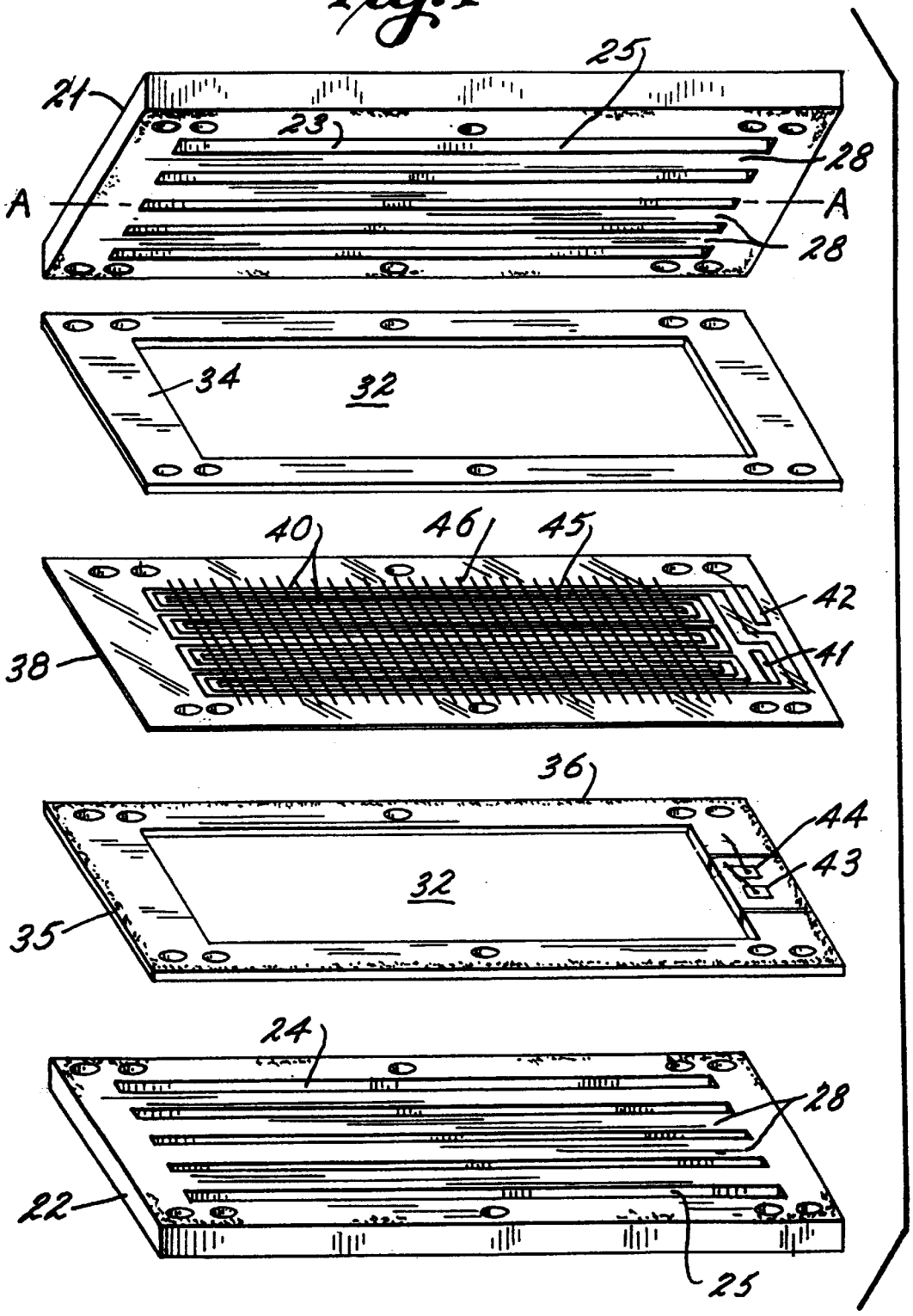
FIG. 1 is a perspective assembly view of a planar magnetic transducer incorporating the improvements of the present invention.

With continued reference to the drawing figures, particularly FIG. 1, a planar magnetic transducer utilized as a loudspeaker of the push-pull type 18 is shown in an exploded or assembly view. The transducer includes an outer frame 20 having opposing frame sections 21 and 22, each of which defines a general open central area 23 and 24, respectively. The frame sections are preferably formed of aluminum or a similar material. A plurality of U-shaped steel channels 25 are fixedly mounted in spaced relationship with respect to one another to each of the frame sections and extend in an open manner from the inside surface of each frame section and across the open central areas. One or more permanent magnets 28 are mounted within each of the channels 25 and, in the preferred embodiment, are mounted such that the poles of the magnets retained in the channels 25 of the frame section 21 oppose like poles of magnets 28 retained in the channels 25 of the opposite frame section 22. Therefore, in the preferred embodiment, either the north poles of the permanent magnets are opposing one another when the frame sections are assembled or the south poles of the permanent magnets are mounted in opposing relationship. In the embodiment disclosed, the permanent magnets 28 within the channels 25 extend generally parallel to a longitudinal central axis "A—A" of the outer frame sections.

Figures 2, 3, 4, 5:
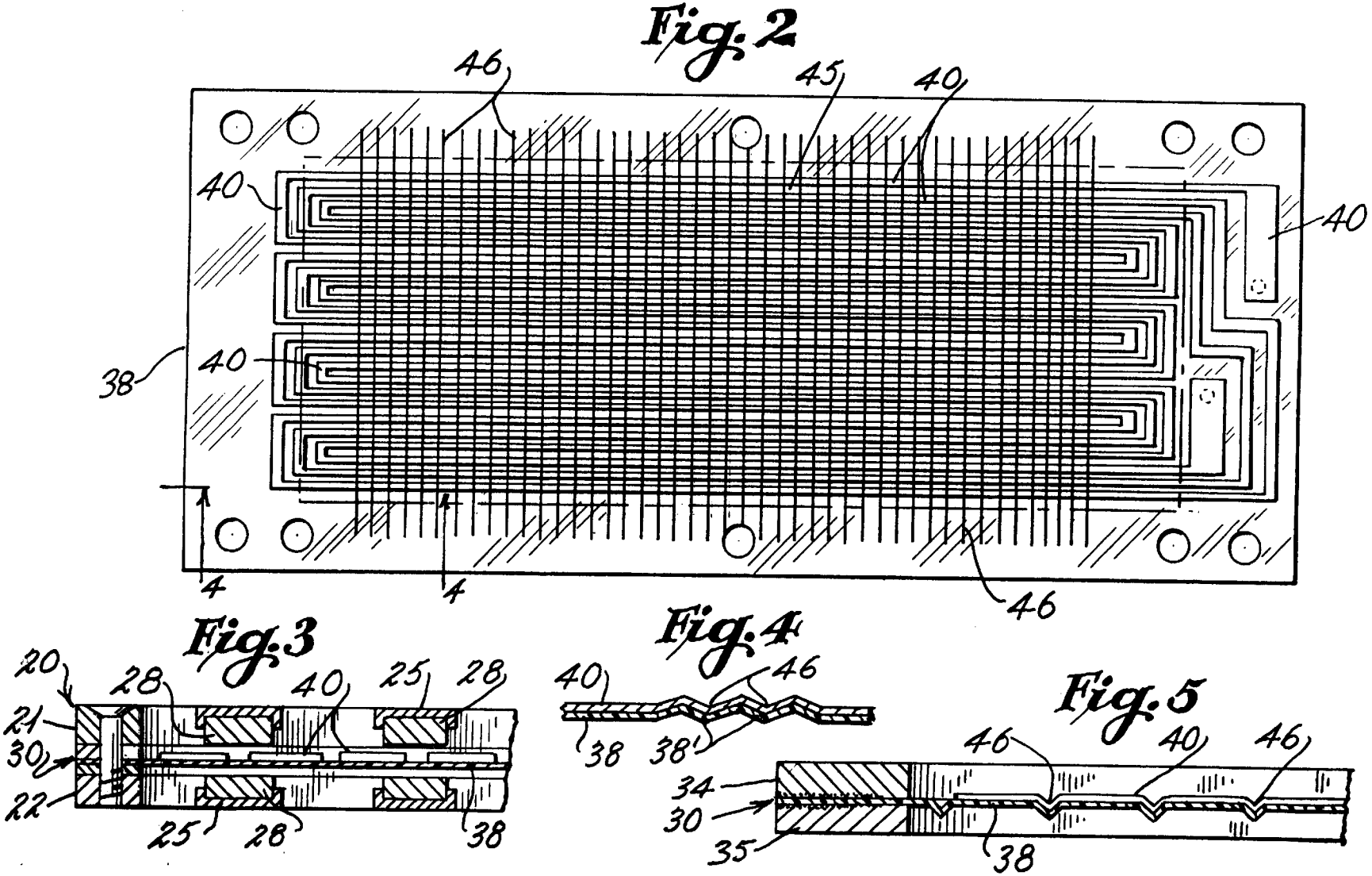
FIG. 2 is a top plan view of the diaphragm shown in FIG. 1.
FIG. 3 is an enlarged partial cross-sectional view taken along line 3—3 of FIG. 1.
FIG. 4 is an enlarged partial cross-sectional view of the diaphragm shown in FIG. 1 in a relaxed state before mounting to a support frame.
FIG. 5 is an enlarged cross-sectional view of a portion of an active surface area of the diaphragm shown in FIG. 1 showing the depressed lines formed therein.

Mounted intermediate the outer frame sections 21 and 22 is an inner speaker diaphragm frame 30, see FIGS. 3 and 5, which is constructed of aluminum. The inner frame also consists of opposing frame sections 34 and 35 between which a flexible diaphragm 38 is secured under tension. The inner frame defines an open area 32. When assembled, the diaphragm is retained in a tensioned relationship between the inner frame halves 34 and 35 by use of suitable adhesives 36 after which the frame halves may be further secured by the use of mechanical fasteners as necessary. The diaphragm is formed of a thin flexible plastic material, such as Mylar™, which is generally less than one mil in thickness.

One surface of the diaphragm is provided with a voice grid pattern consisting of generally parallel runs of an electrical conductor 40. As shown in the preferred embodiment, the conductor runs are oriented generally parallel with respect to the permanent magnets retained within the channels 25 of the outer frame sections 21 and 22. The conductor runs are connected at 41 and 42 to positive and negative terminals 43 and 44 of the frame section 35 which are designed to be electrically connected to a suitable amplifier (not shown). The conductor runs 40 are preferably formed of aluminum or clad-aluminum. The conductor runs are shown as being generally rectangular in configuration, however, the runs along the surface of the diaphragm 38 may take a variety of forms including round or oval forms. The conductors are bonded to the diaphragm or, in an alternative embodiment, are foil conductor patterns which are chemically etched or cut from a foil laminate applied to the surface of the diaphragm. The conductor dimensions, compositions and circuit arrangements are chosen to meet desired circuit impedance requirements and maximum efficiency within practical limitations. The aluminum and clad-aluminum conductors are preferred due to their lower mass and lower overall mass-resistivity over other conductor metals. A lower mass has the advantage of allowing for fast transient response and lower mass-resistivity equates to higher efficiency.

The diaphragm 38 having the conductor runs 40 thereon is normally tensioned, stretched or held in a taut configuration within the inner frame 30 in a plane parallel to the pole faces of the permanent magnets 28 and such that the diaphragm is spaced generally equidistant between the permanent magnets on either side thereof. The area of the diaphragm which is located inside the inner frame is referred to as the "active surface area" 45 of the diaphragm. This is the area that is not constrained from motion by the frame sections. The conductor runs extend generally parallel to the edges or pole faces of the permanent magnets. The path of the conductors of the diaphragm is generally chosen so that current flowing through the conductor runs induces net magnetic forces of uniform direction for all of the conductor segments or runs across the active surface area thereby causing the general direction of the diaphragm motion to be perpendicular to the diaphragm surface.

As the size of the planar magnetic loudspeaker is reduced, the tensioning of the diaphragm 38 requires precise and uniform application of force to prevent audible distortion. Audible distortion is further created during the use of the transducer as heat builds up as energy is applied through the conductor runs, thus causing greater displacement of the diaphragm in a vibratory mode. In an effort to reduce the non-uniform displacement of the diaphragm caused either by improper tensioning or by temperature variation along the conductor segments, it has been determined that the diaphragm and/or the conductor runs within the active surface area of the diaphragm, should be physically deformed in order to both predefine a path for thermal expansion of the diaphragm due to the heating of the conductor runs as well as to prevent loss of diaphragm tension.

As shown in FIG. 1, in the preferred embodiment, a plurality of lines 46 are formed by rollers, embossers or knurling devices in a pattern which extends generally perpendicularly across the active surface area 45 of the diaphragm 38 and across the conductor runs 40. The lines 40 may be formed as generally V- or U-shaped grooves or otherwise formed in some depressed patterned configuration, such as by embossing. The lines generally are generally spaced at a distance at least one millimeter (1 mm) with respect to one another. The spacing and configuration of the score lines may vary depending upon the ultimate application for the transducer.

In the methodology of the present invention, it is preferred that the lines or knurl pattern be formed on the active surface area of the diaphragm when the diaphragm is in a relaxed state before it is tensioned and placed within the inner support frame 30. The lines of depression may be formed using a vacuum table with the appropriate pattern embedded in the table or, alternatively, the diaphragm material may be supported on a rigid support surface and a plurality of embossing or knurling rollers utilized to form the lines. Thereafter, the diaphragm is placed within an appropriate frame and the frame is manipulated to stretch the diaphragm generally uniformly in all directions so that equal tension is applied throughout the diaphragm. With the diaphragm pulled taut, the diaphragm is placed within the inner frame sections 34 and 35 and adhered between the frame sections as they are joined to one another to thereby retain the diaphragm in proper tension. The deformed areas of the active surface area of the diaphragm will function to maintain uniform tension and reduce wrinkling of the diaphragm and thus increase speaker performance. The above process increases the maximum sustainable output of the smaller planar magnetic transducers by as much as 5 to 10 dB. Such mechanical deformation also reduces the need for precise tensioning of the diaphragm within the inner frame.

With particular reference to FIG. 4, an enlarged cross-sectional view of the deformed lines in the diaphragm are shown in greater detail with the diaphragm in a relaxed state. As shown, the lines 46 create an accordion effect throughout the active surface area of the diaphragm 38 or at least preselected portion thereof. Even when the diaphragm is drawn into a taut and tensioned configuration, as shown in FIG. 5, the diaphragm will have the ability to further stretch due to the mechanical deformed lines in the active surface area 45.

Figure 6:
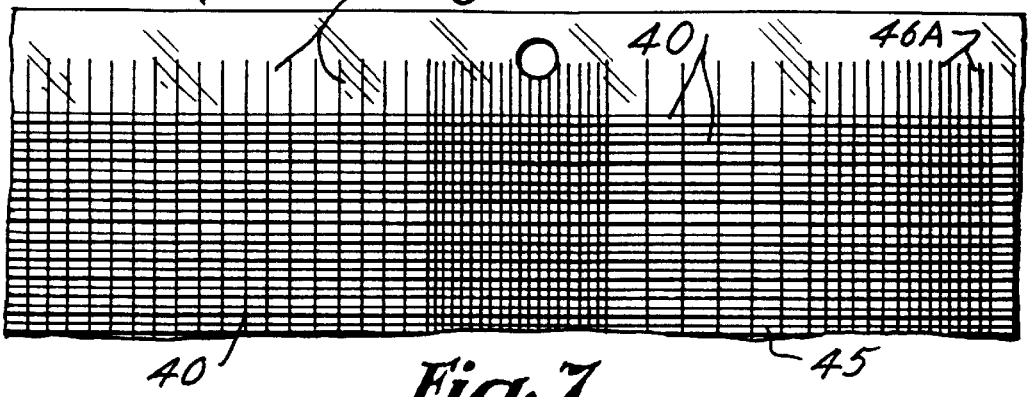
FIG. 6 is a partial top plan view of an alternate embodiment of the present invention showing a varied density of lines of mechanical depression applied to the diaphragm and conductor runs of FIG. 1.

With particular reference to FIG. 6, an alternate embodiment for mechanically deforming the diaphragm and conductor runs is shown in greater detail. In this embodiment, the density of the lines 46A is varied depending upon the areas of the diaphragm which require greater flexibility to prevent loss of non-uniform displacement of the diaphragm during use. Often, the areas in the central portion of the diaphragm will exhibit greater loss of tension and therefore a higher density of mechanical deformation or lines of depression will be anticipated in this area.

Figure 7:
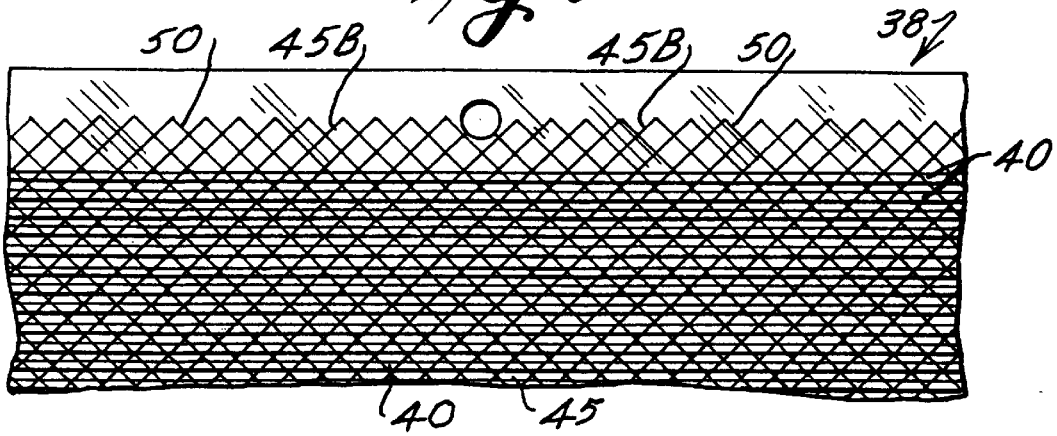
FIG. 7 is a view similar to FIG. 6 showing an alternate embodiment of transverse deformations being formed across the diaphragm.

With respect to FIG. 7, another embodiment of the present invention is shown wherein the lines 45B are shown as extending transversely at an angle of less than 90° with respect to the conductor runs 40. In some embodiments, and as shown, additional intersecting lines 50 may be provided which extend transversely generally perpendicularly with respect to the lines 46B. This configuration allows a more bi-axially expansion and contraction of the diaphragm and conductor runs and may be beneficial in some transducers.

Figure 8:
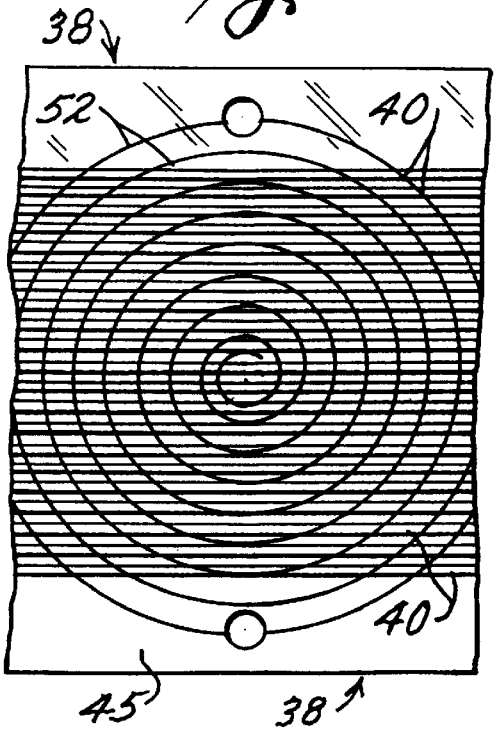
FIG. 8 is a view similar to FIG. 6 of a further alternate embodiment of the present invention showing a spiral deformation being applied to the surface of the conductors and the diaphragm.
Figure 9:
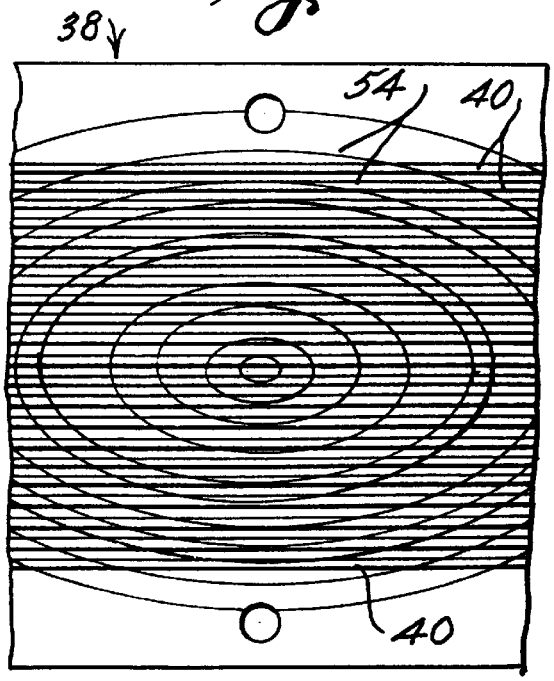
FIG. 9 is a view similar to FIG. 6 of an alternate embodiment of the present invention showing the application of concentric lines of depression formed in the surface of the diaphragm.

In a further embodiment, as shown in FIGS. 8 & 9, it is possible to further provide for multi-axial expansion of the diaphragm 38 and conductor runs 40 by deforming the active surface area 45 of the diaphragm and the conductor runs by utilizing either a spiral or concentric rings to define the areas of deformation. In FIG. 8, a continuous spiral 52 extending from the central portion of the diaphragm outwardly is shown. This type of deforming allows a multidirectional expansion of the diaphragm relative to the central portion thereof. FIG. 9 shows a plurality of concentric circles or ovals 54 extending from the central portion of the diaphragm and outwardly with respect thereto. The concentrically deformed lines may also be formed in concentric rectilinear configurations beginning at the inside and extending outwardly from the central portion of the diaphragm.

In view of the foregoing, the mechanical deformation of the active surface area of the diaphragm and the conductor runs extending across the active surface is beneficial in order to prevent loss of tension in the diaphragm and to thereby provide a more uniform placement of the diaphragm during the operation of the transducer. The configuration and density of the deformations may take various forms depending upon the particular output requirements and frequency responses of a particular transducer.

Although the preferred embodiment is shown incorporating a generally rectangular diaphragm, the diaphragm may take other configurations, including circular or oval configurations. Likewise, the conductor runs may be applied to the active surface area of the diaphragm in other patterns, including circular or oval patterns, and remain within the teachings of the present invention.

Although the preferred embodiment discloses deforming the diaphragm and the conductor runs across the active surface area of the diaphragm, in some instances it may be desired to selectively deform only portions of the surface of the diaphragm and/or the surface areas of the conductors. It is possible to selectively stamp, knurl or otherwise deform only portions or segments of the conductor runs which extend along underlying resident areas 38' of the diaphragm, see FIG. 4. The resident areas are those areas covered by the segments of the conductor runs. Such mechanical deforming may be oriented generally perpendicularly across the surface of the conductor runs or may be oriented transversely with respect to the length of the conductor runs. In some embodiments, the deforming lines may also be formed on the surface of the conductor runs as intersecting lines. As with the previous embodiments, the density of the deformations may also vary depending upon the condition of the conductor runs relative to the surface of the diaphragm.

The foregoing description of the preferred embodiment of the invention has been presented to illustrate the principles of the invention and not to limit the invention to the particular embodiment illustrated. It is intended that the scope of the be defined by all of the embodiments encompassed within the following claims and their equivalents.

What is claimed is:

1. A planar magnetic transducer including:

a frame, a diaphragm secured to said frame and having an active surface area under tension spaced inwardly of said frame, an electrical conductor means on said active surface area of said diaphragm, a plurality of magnet means mounted so as to be spaced from said diaphragm;

the improvement comprising:

at least a segment of said conductor means and at least a segment of said active surface area being deformed so as to permit expansion and contraction of said conductor means and said active surface area when the transducer is in use.

2. The planar magnetic transducer of claim 1 wherein said at least a segment of said conductor means comprises a plurality of spaced segments and said at least a segment of said active surface area comprises a plurality of spaced segments, said spaced segments of said conductor means and said spaced segments of said active surface area are mechanically deformed to create lines of depression therein.

3. The planar magnetic transducer of claim 2 wherein said conductor means are applied to said active surface area so as to define a plurality of substantially parallel rows, and said lines extend transversely with respect to said rows across said active surface area of said diaphragm.

4. The planar magnetic transducer of claim 3 wherein said lines extend generally perpendicularly with respect to said rows.

5. The planar magnetic transducer of claim 2 wherein said active surface area is tensioned in a plurality of varied axial directions relative to said frame.

6. The planar magnetic transducer of claim 2 including an outer frame having first and second sections, said plurality of first magnet means being mounted in spaced relationship with respect to one another to said first section and a plurality of second magnet means being mounted in spaced relationship to one another to said second section, said frame being mounted between said first and second sections of said outer frame so that said active surface area of said diaphragm is spaced inwardly of said outer frame.

7. The planar magnetic transducer of claim 6 wherein said plurality of first magnetic means are spaced so as to be aligned with said plurality of said second magnet means.

8. The planar magnetic transducer of claim 2 including electrical input and output terminal means connected to said frame, and circuit means for connecting said input and output terminal means to said electrical conductor means.

9. The planar magnetic transducer of claim 2 wherein said lines are spaced and generally parallel to one another.

10. The planar magnetic transducer of claim 9 wherein said spaced lines extend substantially across said active surface area.

11. The planar magnetic transducer of claim 9 wherein said spaced lines are spaced relative to one another at a distance of at least one millimeter (1 mm).

12. The planar magnetic transducer of claim 2 in which said lines are generally concentric with respect to one another.

13. The planar magnetic transducer of claim 2 wherein said lines are generally arcuate.

14. The planar magnetic transducer of claim 2 wherein said lines form a generally continuous spiral.

15. The planar magnetic transducer of claim 2 wherein said lines intersect with another within said active surface area.

16. The planar magnetic transducer of claim 2 wherein said lines differ in density across said active surface area.

17. A planar magnetic transducer including:

a frame;

a diaphragm secured to said frame and having an active surface area under tension spaced inwardly of said frame; and a plurality of magnet means mounted in spaced relationship relative to said diaphragm;

an electrical conductor means on said active surface area of said diaphragm, said electrical conductor means being mechanically deformed along spaced segments of its length to thereby reduce loss of tension of said active area by permitting expansion and contraction of said spaced segments of said conductor means and thus control resonance modes along said active surface area of said diaphragm.

18. The planar magnetic transducer of claim 17 wherein said electrical conductor means and said active surface area of said diaphragm are deformed as a plurality of lines of depression within said active surface area.

19. A planar magnetic transducer including:

a frame, a diaphragm secured to said frame and having an active surface area under tension spaced inwardly of said frame, an electrical conductor means on said active surface area of said diaphragm, a plurality of magnet means mounted so as to be spaced from said diaphragm;

a plurality of spaced segments of said conductor means and said active surface area of said diaphragm being deformed in spaced locations so as to permit expansion and contraction of said conductor means and said active surface area when the transducer is in use.

20. The planar magnetic transducer of claim 19 wherein said conductor means includes a plurality of substantially parallel rows, and said spaced segments extending transversely with respect to said rows across said active surface area of said diaphragm.

* * * * *